United States Patent [19]

Goodwin

[11] 4,271,629

[45] Jun. 9, 1981

[54] PROPELLER DRIVEN AERIAL TOY

[76] Inventor: Burnus R. Goodwin, 5326 S. Newport, Tulsa, Okla. 74105

[21] Appl. No.: 157,320

[22] Filed: Jun. 9, 1980

[51] Int. Cl.[3] ..... A63H 27/00

[52] U.S. Cl. ..... 46/78; 46/208

[58] Field of Search ..... 46/82, 84, 78, 75, 208, 46/74 R, 77

[56] References Cited

U.S. PATENT DOCUMENTS

| | | | |
|---|---|---|---|
| 962,172 | 6/1910 | Smith | 46/78 |
| 1,321,206 | 11/1919 | Hansburg et al. | 46/208 |
| 2,189,763 | 2/1940 | Schimpfle | 46/84 |
| 3,479,764 | 11/1969 | Meyer et al. | 46/75 UX |
| 3,787,997 | 1/1974 | Lemelson | 46/78 |

*Primary Examiner*—Gene Mancene
*Assistant Examiner*—Mickey Yu
*Attorney, Agent, or Firm*—William S. Dorman

[57] ABSTRACT

A propeller driven toy comprising a hollow cylindrical elongated fuselage having radially spaced fins mounted thereon, a front propeller rotatably mounted on the forward end of the fuselage and having a circular hub provided with inwardly facing recessed notches along its periphery, four radially spaced blades and a drive shaft extending inwardly through the center of the hub; a rear propeller substantially identical to the front propeller rotatably mounted on the rear end of the fuselage in axial opposition and counter-rotating to the front propeller; a rubber band interconnecting the drive shafts and their respective hubs; a locking mechanism housed internally of the fuselage comprising a wheel rotatably mounted on a horizontal shaft, a lever having its inner end rotatably received on the wheel shaft and interposed between the sides of the wheel and having its outer end free to project outwardly from fuselage, a pair of elongated lock rods in offset axial alignment with the fuselage having their inner ends mounted on the wheel and their outer ends adapted to engage the recessed notches; a spring slidably received on one of the lock rods and adapted to compress when the rods are extended into the notches thus inhibiting the rotation of the propellers; and a catch employed to hold the lever in a position perpendicular position to the fuselage; and wherein turning of the lever from its perpendicular position rotates the wheel to retract the rods out of the notches, thus releasing the propellers.

4 Claims, 5 Drawing Figures

PROPELLER DRIVEN AERIAL TOY

BACKGROUND OF THE INVENTION

1. Field of the Invention

The present invention relates to propeller driven aerial toys, and more particularly to a toy having a pair of axially-opposed counter-rotating propellers powered by a rubber band motor.

2. Prior Art

Propeller driven aerial toys which are powered by rubber band motors are well known in the prior art, including the type comprising counter-rotating propellers. However, the majority of the prior art toys are generally awkward in their operation; in that, one or more of the propellers must be held by hand to prevent their rotation while the other hand turns the one remaining propeller in order to wind the rubber band motor. In U.S. Pat. No. 3,479,464 to Meyer et al., an aerial toy is disclosed having a tined collar slidably mounted on the lower end of its fuselage. The collar is slid downwardly along the body (fuselage) of the toy until its tines engage the blades of the lower propeller thus inhibiting its rotation. It is then possible to wind the motor by turning the upper propeller without holding the lower one by hand. Once the rubber band motor is wound, the upper propeller must be held by one hand while the lower propeller is grasped in the other hand so that the fingers of the same can push the collar forward thereby disengaging the lower propeller blades. The hands must then release their respective blades simultaneously in order for the toy to fly properly.

No prior art device employs a means for engaging both propellers at the same time and which incorporates a spring-loaded firing means that disengages or releases the propellers simultaneously, thereby requiring only one hand to launch the toy.

SUMMARY OF THE INVENTION

The present invention relates to propeller driven aerial toys, of the type having counter-rotating propellers powered by a rubber band motor, and, in operation, simulating the action of a rocket toy. The "rocket toy" of the present invention is provided with a locking and firing mechanism which engages both propellers at the same time and also provides a spring-loaded release means capable of being operated with only one hand.

The rocket toy of the present invention is comprised of a hollow elongated cylindrical main body or fuselage having a plurality of radially spaced fins mounted thereon. One set of fins is located approximately at the midsection of the fuselage and the remaining set is located closely adjacent the rear or bottom end of the fuselage.

The fuselage is provided with a pair of axially-opposed counter rotating propeller assemblies. The front propeller assembly is rotatably mounted on the forward end of the fuselage and is comprised of a circular propeller hub which has a plurality of inwardly facing recessed notches along its periphery and four radially spaced propeller blades. A drive shaft, having a hook on one end, extends through the center of the hub and into the main body of the rocket so that its hook is internal of the fuselage. The front propeller assembly is also provided with a nose cone affixed to its outer end. A rear propeller assembly is rotatably mounted on the rear or bottom end of the fuselage and is substantially identical to the front propeller assembly.

A rubber band motor is disposed internally in the fuselage and its ends are received on the hooks of the drive shafts thus interconnecting the shafts and their respective propeller assemblies. The rocket toy is powered by winding the rubber band relatively tightly so that when the rocket is launched by releasing the propellers, it will fly upwards. The forward propeller pulls the rocket by rotating in a clockwise direction and the rear propeller pushes the rocket by rotating in counter-clockwise direction.

A locking and firing (releasing) mechanism is housed internally of the main body and comprised a wheel rotatably mounted on a wheel shaft running transverse to the main body. A lug is affixed to a portion of the outside of the wheels so that it engages a stop within the body of the locking mechanism thus limiting the rotation of the wheel about the shaft. A lever is employed to rotate the wheel and is interposed between the sides of the same. One end of the lever is rotatably received on the wheel shaft and its opposite end extends outwardly therefrom through a slot so as to be external of the fuselage.

The wheel is provided with a pair of elongated lock rods which are in offset alignment with the longitudinal axis of the main body and which have their inner ends affixed to one side of the wheel. The outer ends of the lock rods are adapted to engage the recessed notches of the propeller hubs. A spring is slidably received on one of the lock rods and is adapted to compress when the lock rods are in an extended position wherein their outer ends have engaged the notches thus inhibiting the rotation of the propeller assemblies.

A catch is employed to hold the lever in a position perpendicular to the main body. When the lever is turned, it rotates the wheel which subsequently releases the spring causing the lock rods to retract out of the notches thus releasing the propeller assemblies for free rotation.

DESCRIPTION OF THE PREFERRED EMBODIMENTS

The present invention relates to propeller driven aerial toys of the type having counter-rotating propellers powered by a rubber band motor and which, in operation, simulates the action of a rocket toy.

Figure 1:
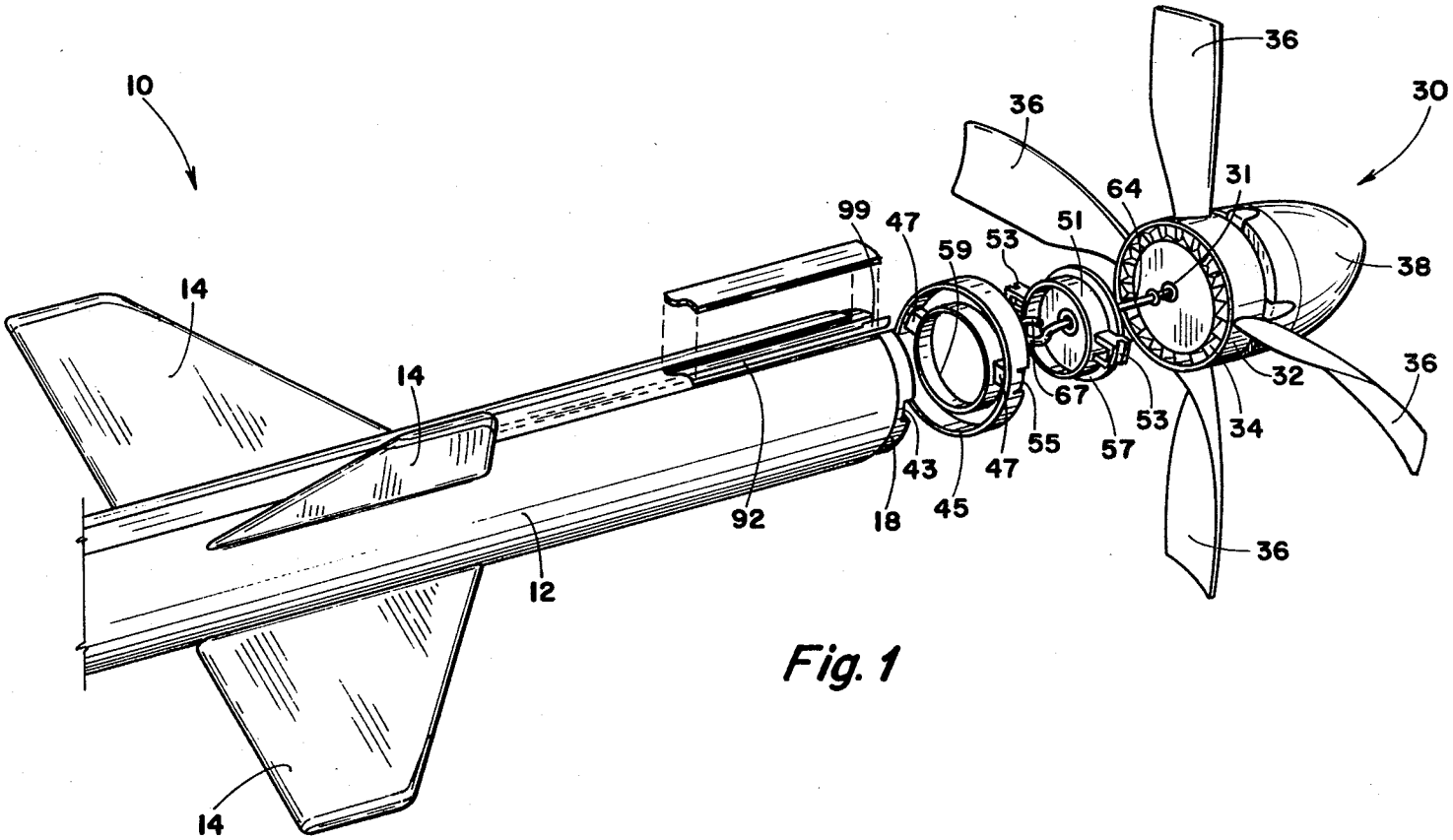
FIG. 1 is a perspective view of the forward or upper portion of the aerial toy of the present invention with certain parts exploded away from the main body for the purpose of clarity.
Figure 2:
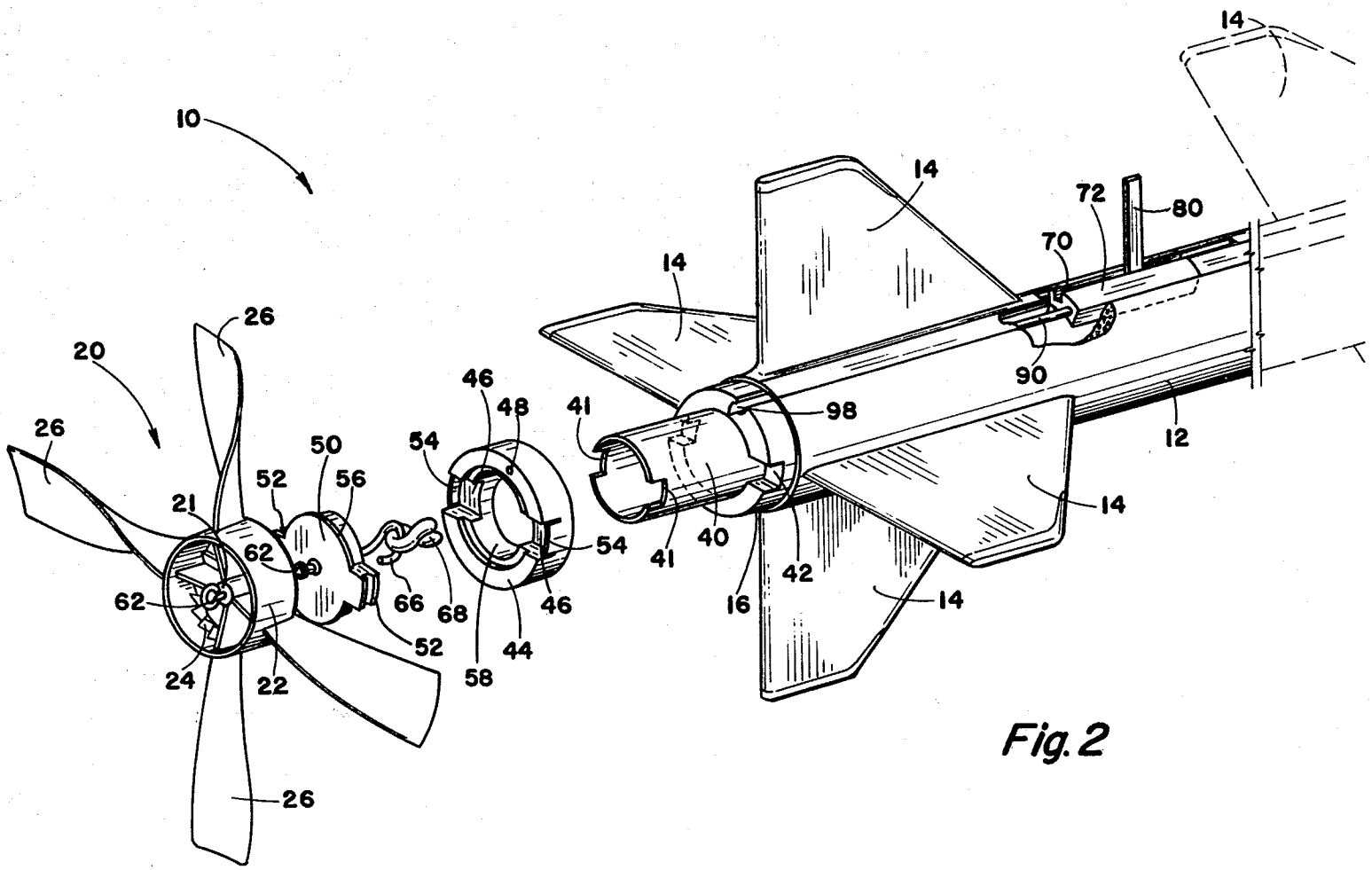
FIG. 2 is a perspective view of the rear or bottom portion of the aerial toy of FIG. 1 with certain parts exploded away from the main body for the purpose of clarity.

Referring to FIGS. 1 and 2 of the drawings, a "rocket" toy 10 of the present invention comprises a hollow elongated cylindrical main body or fuselage 12 which is provided with a plurality of radially spaced fins 14. As shown, one set of fins 14 is located approximately at the midsection of fuselage 12 and the remaining set is located closely adjacent the rear or bottom end 16 of the fuselage. The fuselege and the fins are preferably made from molded styrofoam or the like.

The fuselage is provided with a pair of axially-opposed counter-rotating propeller assemblies. A rear propeller assembly 20 is rotatably mounted on the rear end 18 of fuselage 12. Rear propeller assembly 20 comprises a circular propeller hub 22 having a plurality of inwardly facing recessed notches 24 along its entire periphery and four radially space propeller blades 26 extending outwardly from its center 21.

As shown in FIG. 1, a front propeller assembly 30 is rotatably mounted on the rear end 18 of fuselage 12. Front propeller assembly 30 is substantially identical to rear propeller assembly 20 in that, front propeller assembly 30 comprises a propeller hub 32 having recessed notches 34 and four radially spaced propeller blades 36 extending outwardly from its center 31. The front propeller assembly is also provided with a nose cone or spinner 38 which is received on the outer edge of hub 32 and is made preferably from a soft foam rubber. Both propeller assemblies are preferably made from a molded plastic.

As best illustrated in FIG. 2, a plastic tube 40 is inserted into rear end 16 of fuselage 12 and is slid inwardly so that tube 40 extends the full length of the fuselage and fits flush with the rear end and the front end. A pair of tube notches 41 of plastic tube 40 should be aligned with a pair of matching rear fuselage notches 42 on the rear end 16. The plastic tube has another pair of corresponding forward notches (not shown) which will be aligned with matching forward fuselage notches 43 on forward end 18 (See FIG. 1). An extremely thin plastic sheath or rear cap 44 is affixed to rear end 16 thus providing a plastic tip for the same. Rear cap 44 is provided with a set of recesses 46 which fit into the tube and into corresponding fuselage notches 41 and 42, respectively, and with a hole 48 whose purpose will be disclosed hereafter. A rear plug and bushing assembly 50 fits inside the open center of rear cap 44. A pair of nibs 52 of rear plug and bushing assembly 50 frictionally engages the lips 54 of rear cap 44 and the lid 56 is securely seated on the rim 58 thus preventing rear propeller assembly 20 from falling off during free rotation.

Returning to a further consideration of FIG. 1, a forward cap 45 is affixed to the forward end and is provided with corresponding recesses 47 which fit into the forward notches of tube 40 and into the corresponding forward fuselage notches 43 and is also provided with a hole 49 (not shown). A forward plug and bushing assembly 51 fits inside the open center of forward cap 45. The nibs 53 of plug and bushing assembly 51 frictionally engage the lips 55 of the forward cap and the lid 57 is also seated on the rim 59 thus preventing front propeller assembly from falling off during free rotation.

Each of the propeller assemblies 20 and 30 is rotatably mounted on a metal drive shaft 62 and 64, respectively. Drive shafts 62 and 64 are affixed to hubs 22 and 32 and extend through their centers 21 and 31 and through the center of plug and bushing assemblies 50 and 51 and caps 44 and 45, respectively, so as to be internal of fuselage 12. The drive shafts are provided with hooks 66 and 67 on their inner ends. The ends of a competition-type rubber band motor 68 is received on hooks 66 and 67 of the drive shafts thus interconnecting drive shafts 62 and 64 and their respective propeller assemblies 20 and 30.

As previously disclosed, rubber band motor 68 is disposed internally of fuselage 12. Rocket toy 10 is powered by winding the rubber band relatively tightly by turning one of the propeller assemblies, such as rear propeller assembly 20, approximately 500 revolutions. When the propellers are released, by a means to be disclosed hereinafter, the rocket will fly upwards. Forward propeller assembly 30 pulls the rocket upward by rotating in a clockwise direction while rear propeller assembly 20 pushes the rocket by rotating in a counter-clockwise direction.

Fuselage 12 is also provided with a short longitudinal slot 70 located between the two sets of fins 14 and beneath which is disposed a locking and firing mechanism 72. Locking and firing mechanism 72 is housed internally of the fuselage.

Figure 3:
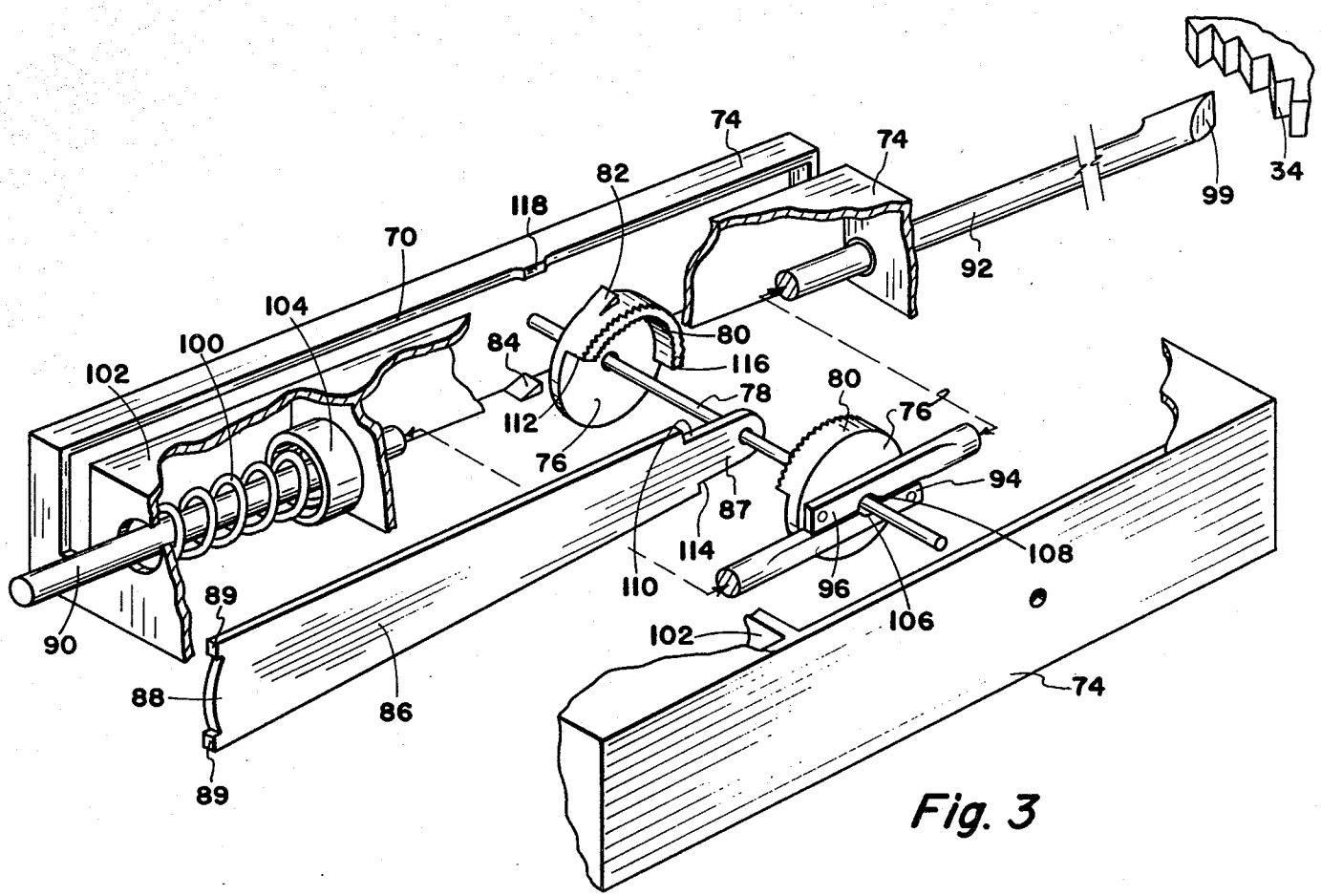
FIG. 3 is an enlarged perspective view of the locking and release mechanism with certain parts exploded and showing the first or retracted position of the operating sequence in accordance with the present invention.

Referring to FIG. 3 of the drawings, the locking and firing mechanism comprises a mechanism housing 74, substantially rectangular in shape and made preferably of molded plastic, as are all of the components of mechanism 72 (except as indicated otherwise). A wheel 76 is rotatably mounted on a metal wire wheel shaft 78 which runs transverse to the mechanism housing 74. Wheel 76 is provided with an interior shoulder 80 which runs circumferentially approximately 180 degrees around a portion of wheel 76 and with a lug 82 located on an outside portion of the wheel at approximately the circumferentially midpoint of shoulder 80. Lug 82 has been adapted to engage a stop 84 affixed to a lower wall of mechanism housing 74 thus limiting the rotation of wheel 76 about wheel shaft 78.

A lever 86 is employed to manually rotate the wheel by pushing against the ends of shoulder 80. As shown, the inner end 87 of lever 86 is rotatably received on wheel shaft 78 and is interposed between the sides of wheel 76. The opposite or outer end 88 of the lever extends outwardly through slot 70 so as to be external of the fuselage (see FIG. 2). Outer end 88 of lever 86 is provided with two tabs, 89, whose purpose will be disclosed hereinafter.

A pair of elongated lock rods, rear rod 90 and forward rod 92, have their inner ends rear 94 and forward 96, respectively, affixed to the outside of wheel 76 along the side opposite of stop 84. Lock rods 90 and 92 are in offset axial alignment with longitudinal axis of fuselage 12 having their outer ends 98 and 99 extending to the respective ends (16 and 18) of the fuselage and through holes 48 and 49, respectively, (see FIGS. 1 and 2). As best shown in FIG. 3, the outer end 99 of lock rod 92 has a chisel point or tip which is engageable with recessed notches 34 of forward propeller hub 32. The outer end 98 (not shown in FIG. 3) of lock rod 90 is also provided with a chisel point or tip which is engageable with the recessed notches of rear propeller hub 22.

A spring 100 is slidably received on a portion of lock rod 90 and is contained within the walls of a spring housing 102. The forward end of spring 100 is covered by a spring retaining cap 104 which is received on lock rod 90 and the rear end of the spring rests against the rear wall of the spring housing.

FIG. 3 shows the retracted or released position in the operating sequence of locking and firing mechanism 72. The chiselled ends (98 and 99) of lock rods 90 and 92 are not engaging (or contacting) the recessed notches of the propeller hubs. Lug 82 is at the top of an arc of the wheel 76 and is not in contact with the stop 84. The inner ends 94 and 96 of the lock rods are closely adjacent the inner portion of the opposite lock rod (92 and 90) so that a portion of wheel shaft 78 is interposed between the semi-circular notches 106 and 108 of lock rods 90 and 92, respectively. Spring 100 is released and retaining cap 104 is contacting the forward wall of spring housing 102. The outer end 88 of the lever faces the rear end of the fuselage with a first lever point 110 contacting the shoulder 80 at a first end point 112.

Figure 4:
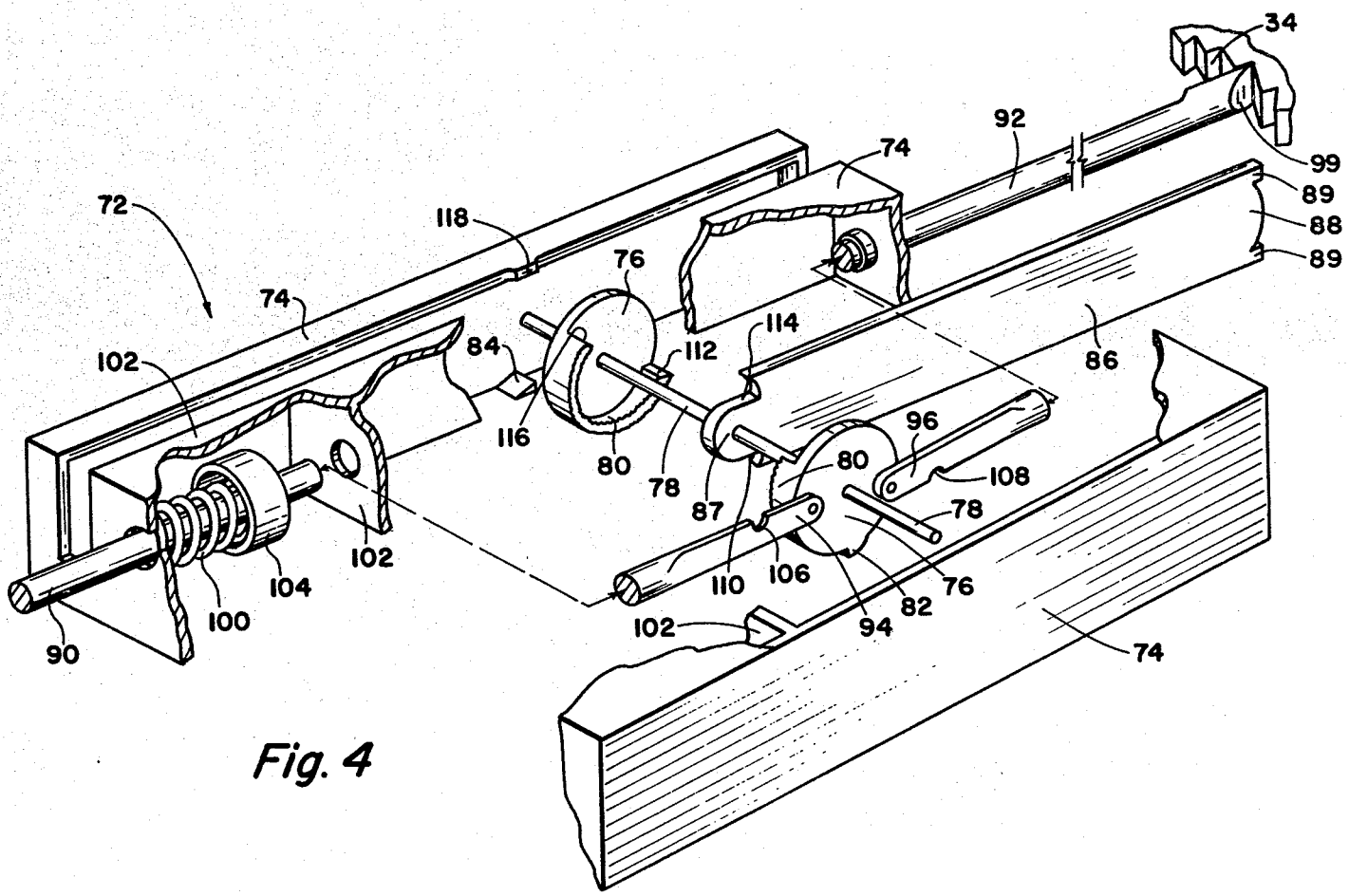
FIG. 4 shows the second or extended position of the operating sequence of FIG. 3.

Referring to FIG. 4, the lever has been moved 180 degrees from its former position in FIG. 3 so that the operating sequence is now in the extended or locked position. Lever 86 was moved manually by inserting a fingernail behind the upper tab 89 and moving the lever across so that its outer end 88 is now facing the forward end of the fuselage. Wheel 76 has been rotated approximately 180 degrees by the action of the lever pushing against the shoulder at its first end point 112. The rotating of the wheel extends lock rods 90 and 92 causing their outer chiselled ends to engage the recessed notches of the propeller hubs which subsequently prevents their rotation. The rubber band motor can be wound by moving a propeller assembly away from the fuselage and then turning it. However, when the propeller assembly is released, it immediately snaps back into a locked position thus avoiding any premature free rotation.

As shown, when lock rod 90 is extended, the retaining cap 104 moves with the lock rod toward the rear wall of the spring housing thereby compressing spring 100. The wheel must be rotated clockwise about 180 degrees or until the lug 82 contacts the stop 84 so that the inner end 94 of lock rod 90 is slightly above center in order to prevent premature release of the spring and the subsequent retraction of the lock rods.

Figure 5:
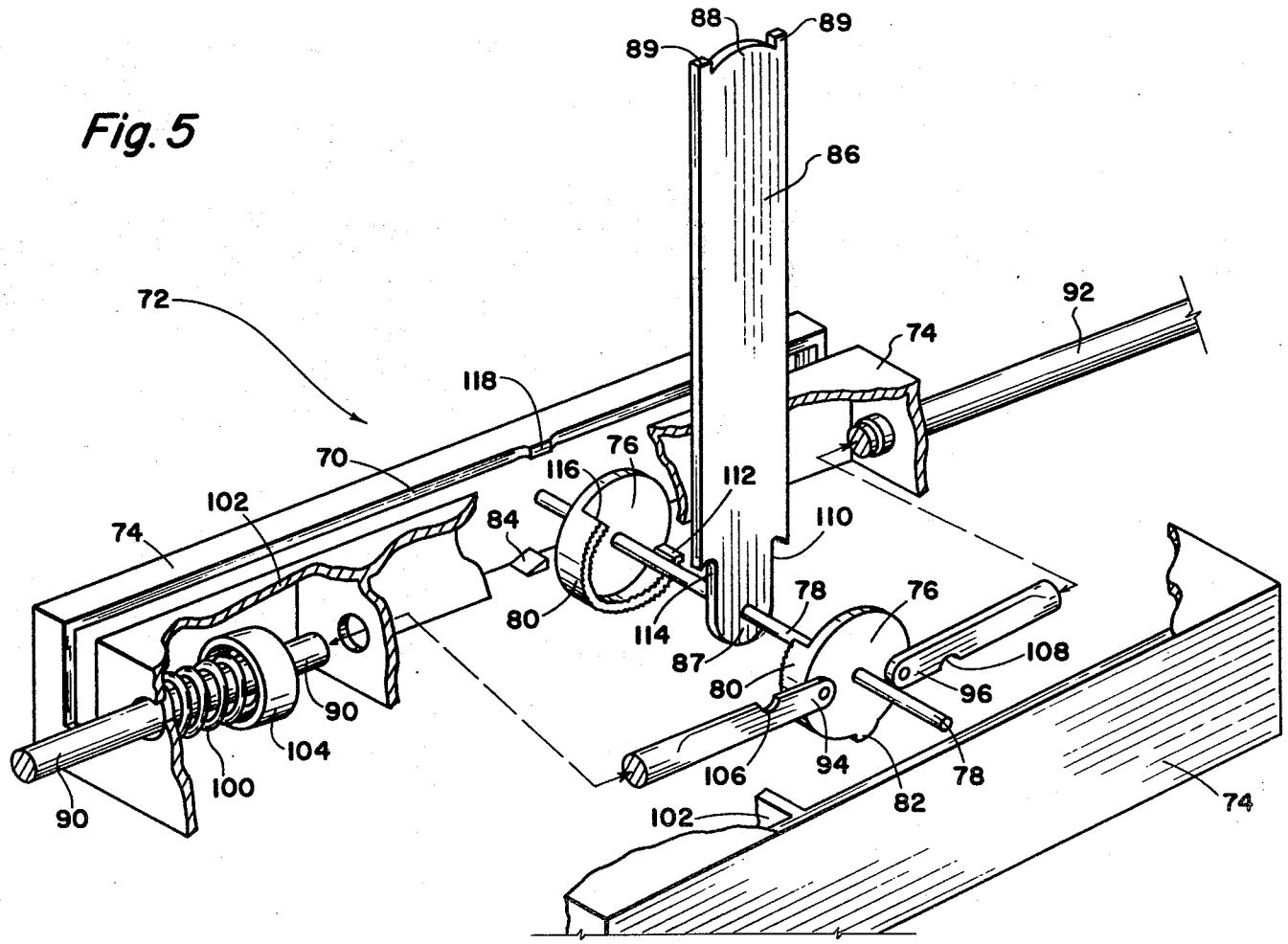
FIG. 5 shows the final position of the operating sequence of FIG. 3.

FIG. 5 shows the final or "ready for firing" position in the operating sequence of the locking and firing mechanism. The lever has been moved manually by means of the remaining tab 89 so that the lever is now perpendicular to the fuselage (See FIG. 2). A second lever point 114 of lever 86 is now contacting shoulder 80 at its second end point 116. The side of the lever is also contacting a catch 118 along the side of the slot which frictionally retains the lever lightly in its perpendicular position.

The rocket toy can now be launched from a hollow cylindrical tube (not shown), or by hand. A slight downward or rearward pressure is applied on the lever so that the spring can force the wheel to rotate rapidly in a counterclockwise direction causing the lock rods to be retracted out of the recessed notches thereby releasing the propeller assemblies for free rotation. Wheel 76 at its first end point 112 contacts the lever at its point 110 moving the lever into the position as shown in FIG. 3.

Whereas the present invention has been described in particular relation to the drawings attached hereto, it should be understood that other and further modifications, apart from those shown or suggested herein, may be made within the spirit and scope of this invention.

What is claimed is:

1. A propeller driven aerial toy comprising a hollow elongated cylindrical main body having a plurality of radially spaced fins mounted thereon, a front propeller assembly rotatably mounted on the forward end of said main body, said front propeller assembly having a circular propeller hub provided with a plurality of inwardly facing recessed notches along its periphery, a plurality of radially spaced propeller blades extending outwardly from the center of said propeller hub and a drive shaft mounted on said propeller hub extending inwardly through said center of said propeller hub and having a hook on its inner end which is internal of said main body; a rear propeller assembly substantially identical to said front propeller assembly rotatably mounted on the rear end of said main body in axial opposition to said front propeller assembly and counter rotating to the same; a rubber band motor disposed internally of said main body and having its ends received on the hooks of the drive shafts thus interconnecting said drive shafts and their respective propeller assemblies; a locking and firing mechanism housed internally of said main body and comprising a wheel rotatably mounted on a transverse wheel shaft, a lever employed to rotate said wheel having one end rotatably received on said wheel shaft so as to be interposed between the sides of said wheel and having its opposite end extending outwardly therefrom, a pair of elongated lock rods in longitudinal alignment with said main body having their inner ends affixed to one side of said wheel and having their outer ends adapted so as to be engageable with the recessed notches of said propeller assemblies, a spring slidably received on a portion of one of the lock rods, means for compressing said spring when said lock rods are in an extended position wherein their outer ends have engaged said recessed notches thus preventing the free rotation of said propeller assemblies, and means for retaining said lever in a perpendicular position to said main body wherein movement of said lever in a predetermined direction rotates said wheel and releases said spring thus retracting said lock rods out of said recessed notches and allowing said propeller assemblies to freely rotate.

2. A propeller driven aerial toy as set forth in claim 1 including means for limiting the rotation of said wheel comprising a lug on an outer portion of said wheel and a stop affixed to a portion of said main body within said locking and firing mechanism and disposed in the path of movement of said lug when said wheel is rotated at a location wherein said lug contacts said stop after said wheel has rotated approximately 180 degrees.

3. A propeller driven aerial toy as set forth in claim 1 wherein said means for compressing said spring comprises a spring housing affixed to a portion of said main body and receiving said spring therein and a fixed retainer cap received on a portion of said one lock rod and covering one end of said spring and having the opposite end of said spring rests against the spring housing, wherein said spring is compressed between said spring housing and said fixed retainer cap when said lock rods are extended.

4. A propeller driven aerial toy as set forth in claim 1 wherein said wheel comprises an opening in which said lever freely rotates and which is provided with a shoulder whereby when said lever is turned in one direction the same pushes against a first end point of said shoulder rotating said wheel to a location over a center point thereby engaging said hubs with said lock rods; and wherein said lever is turned in said predetermined direction being opposite said one direction, said wheel will turn with the aid of said spring thereby releasing said propellers.

* * * * *